US011365613B2

(12) United States Patent
Romer et al.

(10) Patent No.: US 11,365,613 B2
(45) Date of Patent: Jun. 21, 2022

(54) ELECTRICAL SUBMERSIBLE PUMP MOTOR ADJUSTMENT

(71) Applicant: ExxonMobil Upstream Research Company, Spring, TX (US)

(72) Inventors: Michael C. Romer, The Woodlands, TX (US); Stuart G. Luyckx, Westerville, OH (US); Matthew J. Tenny, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 46 days.

(21) Appl. No.: 16/660,318

(22) Filed: Oct. 22, 2019

(65) Prior Publication Data

US 2020/0182029 A1 Jun. 11, 2020

Related U.S. Application Data

(60) Provisional application No. 62/776,738, filed on Dec. 7, 2018.

(51) Int. Cl.

| | |
|---|---|
| ***E21B 47/008*** | (2012.01) |
| ***E21B 43/12*** | (2006.01) |
| ***F04D 13/06*** | (2006.01) |
| *E21B 47/12* | (2012.01) |

(52) U.S. Cl.

CPC ..... *E21B 43/128* (2013.01); *E21B 47/008* (2020.05); *F04D 13/06* (2013.01); *E21B 47/12* (2013.01)

(58) Field of Classification Search

CPC ..... E21B 43/128; E21B 47/008; E21B 13/06; E21B 47/12; E21B 43/12; E21B 47/00; F04D 13/06; F04D 15/0236

See application file for complete search history.

(56) References Cited

U.S. PATENT DOCUMENTS 5,959,431 A * 9/1999 Xiang ..... H02P 27/047 318/811
6,328,102 B1 12/2001 Dean
7,111,675 B2 9/2006 Zisk, Jr.
7,322,803 B2 1/2008 Vogeley
(Continued)

FOREIGN PATENT DOCUMENTS

CN 110837045 A * 2/2020
EP 2 077 374 A1 7/2009
(Continued)

OTHER PUBLICATIONS

Fluke Corporation, Fluke 430 Series II, Three-Phase Power Quality and Energy Analyzers, 2012, pp. 1-8.
(Continued)

*Primary Examiner* — Taras P Bemko
(74) *Attorney, Agent, or Firm* — ExxonMobil Upstream Research Company—Law Department

(57) ABSTRACT

In some examples, an electric submersible pump includes a pump, an electric motor to drive the pump, and a controller. The controller can monitor at one or more terminals of the electric motor a value relating to total harmonic distortion. The controller can also determine whether to de-rate the electric motor in response to the monitoring at the one or more terminals of the electric motor of the value relating to the total harmonic distortion.

28 Claims, 10 Drawing Sheets

400

(56) References Cited

U.S. PATENT DOCUMENTS

| | | | | |
|---|---|---|---|---|
| 7,484,940 | B2 | 2/2009 | O'Niell | |
| 7,597,150 | B2 | 10/2009 | Clem | |
| 8,133,041 | B2 | 3/2012 | Ludlow et al. | |
| 8,220,533 | B2 | 7/2012 | Longfield et al. | |
| 8,511,390 | B2 | 8/2013 | Coyle et al. | |
| 2002/0197174 | A1 | 12/2002 | Howard | |
| 2003/0010491 | A1 | 1/2003 | Collette | |
| 2006/0198742 | A1 | 9/2006 | DiFoggio et al. | |
| 2008/0080991 | A1 | 4/2008 | Yuratich et al. | |
| 2009/0183879 | A1 | 7/2009 | Cox | |
| 2009/0218091 | A1 | 9/2009 | Dotson | |
| 2010/0012313 | A1 | 1/2010 | Longfield | |
| 2012/0023606 | A1 | 10/2012 | Bouldin et al. | |
| 2014/0343743 | A1* | 11/2014 | DaCunha | G06F 1/28 700/291 |
| 2017/0089192 | A1* | 3/2017 | Rendusara | F04D 15/0077 |
| 2018/0183377 | A1* | 6/2018 | McMullen | H02P 27/04 |
| 2019/0044421 | A1* | 2/2019 | Grande, III | H02K 11/40 |
| 2019/0204467 | A1* | 7/2019 | Curt | E21B 47/10 |
| 2019/0393816 | A1* | 12/2019 | Chedygov | H02K 11/33 |

FOREIGN PATENT DOCUMENTS

| | | | | |
|---|---|---|---|---|
| GB | 2 393 747 | A | 4/2004 | |
| GB | 2 403 752 | A | 1/2005 | |
| WO | WO-9215148 | A1 * | 9/1992 | H02P 21/20 |
| WO | WO 01/20126 | A2 | 3/2001 | |
| WO | WO 2009/077714 | | 6/2009 | |
| WO | WO 2011/079218 | A2 | 6/2011 | |
| WO | WO-2019195520 | A1 * | 10/2019 | G01R 19/2509 |

OTHER PUBLICATIONS

IEEE Standards Association, IEE Recommended Practice and Requirements for Harmonic Control in Electric Power Systems, IEEE Power and Energy Society, Sponsored by the Transmission and Distribution Committee, 2014, pp. 1-17.

Baker Hughes a GE Company, Zenith E-Series ESP Gauages, Prolong ESP Run Life And Enhance Oil Recovery, 2018, pp. 1-6.

Baker Hughes, Artificial Lift Sensors, Well Lift H Downhole Sensor, 2010, pp. 1-2.

* cited by examiner

100

200

300

400

500

600

700

800

900

ELECTRICAL SUBMERSIBLE PUMP MOTOR ADJUSTMENT

CROSS-REFERENCE TO RELATED APPLICATION

This application claims the benefit of U.S. Provisional Application 62/776,738 filed Dec. 7, 2018 entitled "Electrical Submersible Pump Motor Adjustment," the entirety of which is incorporated by reference herein.

FIELD

The techniques described herein relate to electric submersible pump (ESP) motor power quality. More particularly, the techniques relate to determining power quality of a motor of an ESP.

BACKGROUND

This section is intended to introduce various aspects of the art, which may be associated with one or more examples of the present techniques. This discussion is believed to assist in providing a framework to facilitate a better understanding of particular aspects of the present techniques. Accordingly, it should be understood that this section should be read in this light, and not necessarily as admissions of prior art.

Electrical submersible pumps (ESPs) can be used as an artificial lift technique in the oil and gas industry. For example, ESPs can be used to lift liquid volumes in excess of 500 barrels per day (bpd). Additionally, ESPs can have a large number of components, and some systems can reach lengths greater than 100 feet. ESPs can include one or more of an electric motor, a seal/protector, an intake, a gas separator, centrifugal pumping stages, a discharge, and a downhole sensor, for example. The ESP motor can be a three-phase alternating current (AC) induction motor. The ESP motor can also be a permanent magnet motor.

The motor of an ESP can be powered via a cable that extends to the surface and through the wellhead. The motor can be used to spin a shaft that rotates the centrifugal pump stages, increasing the pressure of the pumped fluids so they can be pumped to the surface. The seal/protector section of the ESP can handle the thermal expansion of the motor's oil, can allow the motor internals to equalize pressure in the well environment, and can carry a substantial portion of the thrust load of the ESP.

ESP run lives are generally defined by the environments in which they operate and by how they are operated. Run lives lasting two to three years are common, and some ESP systems can reach a run life of five or more years. A "good" run life may be determined by economics. ESPs can be attached to production tubing and installed with a rig. Therefore, ESP installations and workovers can be expensive, and ESP operators spend considerable efforts on ESP reliability initiatives, since each additional day of run time improves project economics.

SUMMARY

An example provides an electric submersible pump that includes a pump, an electric motor to drive the pump, and a controller. The controller can monitor at one or more terminals of the electric motor a value relating to total harmonic distortion. The controller can also determine whether to de-rate the electric motor in response to the monitoring at the one or more terminals of the electric motor of the value relating to the total harmonic distortion.

Another example provides a method to be implemented in an electric submersible pump. The method includes monitoring, at one or more terminals of an electric motor of the electric submersible pump, a value relating to total harmonic distortion. The method also includes determining whether to de-rate the electric motor in response to the monitoring at the one or more terminals of the electric motor of the value relating to the total harmonic distortion.

In another example, one or more tangible, non-transitory machine readable media include a plurality of instructions. In response to being executed on at least one processor, the instructions can cause the at least one processor to monitor, at one or more terminals of an electric motor of the electric submersible pump, a value relating to total harmonic distortion. In response to being executed on at least one processor, the instructions can also cause the at least one processor to determine whether to de-rate the electric motor in response to the monitoring at the one or more terminals of the electric motor of the value relating to the total harmonic distortion.

The foregoing summary has outlined rather broadly the features and technical advantages of examples in order that the detailed description of the techniques that follow may be better understood. It should be appreciated by those skilled in the art that the conception and specific embodiment disclosed may be readily utilized as a basis for modifying or designing other structures for carrying out the same purposes of the present techniques. It should also be realized by those skilled in the art that such equivalent constructions do not depart from the spirit and scope of the techniques described below. The novel features which are believed to be characteristic of the techniques below, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present techniques.

DESCRIPTION OF THE DRAWINGS

The foregoing and other advantages of the present techniques may become apparent upon reviewing the following detailed description and drawings of non-limiting examples of examples in which.

Figure 1:
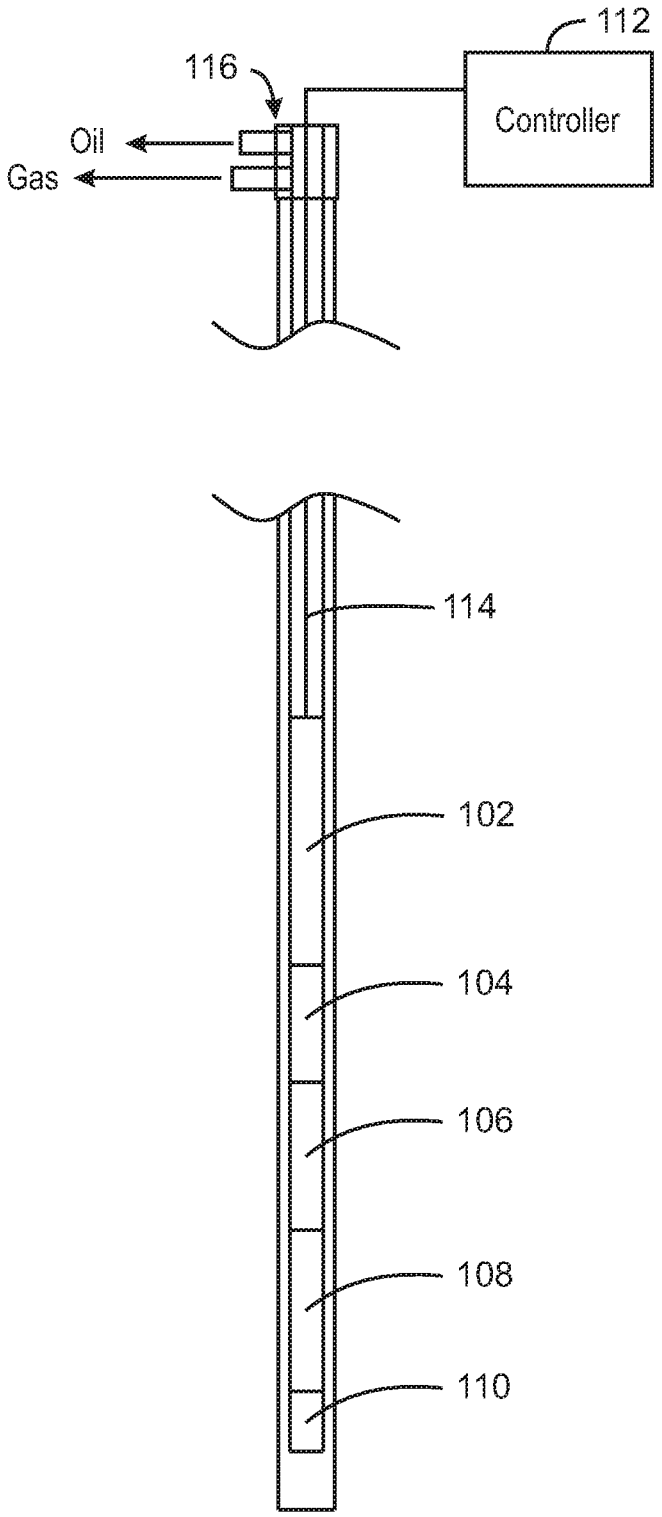
FIG. 1 is an illustration of an example system 100 in accordance with some embodiments.

It should be noted that the figures are merely example of several examples of the present techniques and no limitations on the scope of the present techniques are intended thereby. Further, the figures are generally not drawn to scale, but are drafted for purposes of convenience and clarity in illustrating various aspects of the techniques.

DETAILED DESCRIPTION

In the following detailed description section, the specific examples of the present techniques are described in connection with some examples. However, to the extent that the following description is specific to a particular embodiment or a particular use of the present techniques, this is intended to be for example purposes only and simply provides a description of some examples. Accordingly, the techniques are not limited to the specific examples described below, but rather, it includes all alternatives, modifications, and equivalents falling within the true spirit and scope of the appended claims.

At the outset, and for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

"Drilling" as used herein may include, but is not limited to, rotational drilling, slide drilling, directional drilling, non-directional (straight or linear) drilling, deviated drilling, geosteering, horizontal drilling, and the like. The drilling method may be the same or different for the offset and uncased intervals of the wells. Rotational drilling may involve rotation of the entire drill string, or local rotation downhole using a drilling mud motor, where by pumping mud through the mud motor, the bit turns while the drill string does not rotate or turns at a reduced rate, allowing the bit to drill in the direction it points.

A "well" or "wellbore" refers to holes drilled vertically, at least in part, and may also refer to holes drilled with deviated, highly deviated, and/or horizontal sections of the wellbore. The term also includes wellhead equipment, surface casing, intermediate casing, and the like, typically associated with oil and gas wells.

"De-rate" or "de-rating" refers to an adjustment of devices such as electrical devices, for example, in order to provide for longer device life. For example, the term can refer to adjusting a speed of the device (for example, adjusting a speed of an electric motor). For example, the term can refer to operation of a device (for example, operation of an electric motor) at less than its rated maximum capability in order to prolong its life. For example, the term can relate to operation below a maximum or typical power rating, current rating, or voltage rating, or lowering an operation parameter (such as, for example, lowering power, lowering current, or lowering voltage). The term may refer generally to changing an operating speed of a system, or stopping operation (for example, stopping operation in order to fix a problem).

Some techniques described herein relate to determining power quality of a motor or an electric submersible pump (ESP). For example, some techniques relate to determining power quality of a motor of an ESP based on one or more of total harmonic distortion (THD), maximum voltage, maximum spikes (for example, ringing), voltage change over time, balance and/or imbalance, current balance and/or imbalance, voltage balance and/or imbalance, etc. According to examples described herein, techniques are presented of a controller to monitor at one or more terminals of an electric motor of an electric submersible pump (ESP) a value relating to total harmonic distortion. The controller can also determine whether to de-rate the electric motor in response to the monitoring at the one or more terminals of the electric motor (for example, monitoring at the one or more terminals of the value relating to the total harmonic distortion). In some embodiments, measurement of power quality (PQ) at an electric motor of an ESP can influence one or more of motor de-rating, insight on insulation design change, variable speed drive (VSD) operation change, frequency change away from a resonant excitation frequency, surface filter design and/or performance, etc.

In some embodiments, an electrical submersible pump (ESP) can be used as an efficient and reliable artificial-lift to lift moderate to high volumes of fluids from wells (or wellbores). Such an ESP can include a tubing-hung unit with downhole components including, for example, one or more of a multistage centrifugal pump (for example, in some embodiments, with either an integral intake or a separate intake), a three-phase induction motor, a sensor, and a seal-chamber section. The ESP system can also include a power cable coupling the downhole components to surface controls. In some embodiments, ESP systems can be used to pump a variety of fluids, including, for example, crude oil, brine, liquid petroleum products, disposal or injection fluids, fluids containing free gas, some solids or contaminants, and/or $CO_2$ and $H_2S$ gases or treatment chemicals, among others. Only surface control equipment and the power cable running from the surface controller to the wellhead might be visible. The surface controller may be provided in an outdoor weatherproof version or an indoor version for placement in a building or a container. The surface control equipment might be located within a minimum recommended distance from the wellhead, or can be located miles away from the wellhead.

FIG. 1 is an illustration of an example system 100 in accordance with some embodiments. In some embodiments, system 100 includes an electrical submersible pump (ESP) that can be used in a well or wellbore (for example, an oil and/or gas well or wellbore) for lifting fluids (for example, fluids such as oil and/or gas). In some embodiments, the ESP is used for artificial lift. In some embodiments, the ESP includes a large number of components. In some embodiments, the ESP can include one or more of a pump 102 (for example, a multi-staged centrifugal pump including centrifugal pumping stages), an intake 104, a seal 106 (for example, a seal/protector and/or a seal-chamber section), a motor 108 (for example, an electric motor and/or a three-phase induction motor), and a sensor 110 (for example, a downhole sensor). Although not illustrated in FIG. 1, the ESP can include one or more additional components such as, for example, a gas separator, a discharge, etc. A controller 112 (for example, surface controls and/or a motor control center or MCC) can be coupled to the ESP via one or more power cables 114. In some embodiments, the controller 112 may be a fixed or variable speed controller. In some embodiments, controller 112 can include a variable speed drive (VSD). In some embodiments, one or more power cables 114 can extend to the surface. In some embodiments, one or more power cables 114 can be one or more cable (for example, to one or more ESP cable) banded and/or clamped to the outside of production tubing. A wellhead 116 can include production outlets (for example, oil and/or gas production outlets).

The motor 108 and pump 102 can run on a production string connected back to the controller 112 (and to a transformer) via electric power cable 114. In some embodiments, motor 108 is a three-phase alternating current (AC) induction or permanent magnet motor and is powered via cable 114. The motor 108 can drive pump 102. For example, in some embodiments, motor 108 can spin a shaft that rotates centrifugal pump stages of pump 102 to increase a pressure of the pumped fluids. The ESP pump 102 can pump intermittently or continuously.

As discussed above, sensor 110 can be a downhole sensor installed in the ESP. Sensor 110 can measure one or more of intake/discharge pressures, intake temperature, motor temperature, vibration, and/or flow, for example. In some embodiments, sensor 110 can be coupled to the Y-point (or triple point, or zero voltage point) of motor 108. Sensor 110 can be can be powered from a "slipstream" of electricity that is being delivered to run the ESP and/or motor 108, for example, via power cable(s) 114. Sensor 110 communications may be modulated (or piggy-backed) onto the ESP power signal (for example, the ESP power signal provided via power cable 114) and can be read at the surface (for example, at controller 112).

Harmonics can become an issue with ESP motors. For example, if the phases of the motor get out of sync, more power can end up going to one coil than to other coils and the pump can end up being destroyed. Therefore, in some embodiments, the motor is de-rated (or downrated) to avoid this situation. In some embodiments, a system can be used that includes active filter circuitry that can perform mitigation between the phases by lowering the amount of phase imbalance. In some embodiments, an indication can be sent to the surface to alert the surface controller that a level of imbalance is occurring so that a surface motor controller can do something about the imbalance. In some embodiments, an indication can be provided relating to power quality of an ESP motor (relating to, for example, one or more total harmonic distortion (THD), maximum spikes, ringing, imbalance, etc.) In some embodiments, a measurement and/or indication of power quality of an ESP motor can influence one or more of motor de-rating, insight on insulation design change, variable speed drive (VSD) operation change, frequency change away from resonant excitation frequency, surface filter design and/or performance, etc. In some embodiments, an indication can be provided that results in design changes such as, for example, increasing a motor and/or insulation rating, cable design changes (for example, round vs. flat, transpositional splices, etc.), and/or VSD output filter performance evaluation. In some embodiments, de-rating or downrating of the motor 108 can include, for example, adjustment of the motor in order to provide for longer device life, adjustment of a speed of the motor, operating the motor at less than its rated maximum capability, operating the motor below a maximum or typical power rating, current rating, or voltage rating, lowering an operation parameter of the motor (such as, for example, lowering power, current, and/or voltage supplied to the motor), changing an operating speed of the motor, and/or stopping operation of the motor.

An ESP driven by an electric motor can be susceptible to poor power quality issues (for example, poor output power quality issues). Power readings can be measured at the surface at a variable speed drive (VSD) outlet or another suitable port. Voltage and amperage values can be tracked (for example, at a VSD outlet) in a relatively simple manner. However, dynamic output power quality is more difficult to measure, since a 10 kHz or higher sampling frequency may be required to assess the relevant harmonics. This can be particularly difficult using VSDs, since they re-form the power they receive to provide variable frequency power to another device such as an ESP motor. VSD input power quality specifications are well known, for example, as outlined in the Institute of Electrical and Electronic Engineers (IEEE) 519 spec. However, output power specifications are not as well defined or stringent, and ESP motors are affected by a VSD's output power. Poor power quality (harmonics) can lead to excessive motor heating, insulation damage, bearing fluting, and other issues that can decrease the run life of an ESP.

Output power quality could be measured at the surface with modeling assistance. However, ESP VSDs typically output to a step-up transformer, and a measurement of total harmonic distortion (THD) would likely need to be at the output (high-voltage) side of the transformer. This high-voltage could be in a range of around 3-5 kV, which makes measurement a challenge. If the measurement point were on the low voltage side, the relatively high current (for example, several hundred Amps) could also be an issue, and the transformer effects would likely require modeling. Such a surface measurement would need to be re-processed to account for the additional capacitance in the lengthy power cable from the measurement point to the ESP, and changes in the power line capacitance from any initial assumptions would be difficult to account for. Improper ramp-up voltages (rise times) and ringing can be amplified by cable characteristics, resulting in damaging spikes at the ESP motor. Additionally, measurement at the surface power supply do not take the downstream electrical system into account, and cables/penetrators are known to fail.

If a total harmonic distortion (THD) such as, for example, total harmonic distortion on the voltage (THDv) or total harmonic distortion on the current (THDi), is greater than a threshold (for example, is greater than 3%) at a motor's terminals, it is advantageous to de-rate (or downrate) the motor. For example, the National Electrical Manufacturers Association (NEMA) MG-1 specification indicates that if Total Harmonic Distortion-Voltage (THDv) is >3% at a motor's terminals, the motor should be de-rated. However, in the case of an ESP motor, measurement of a VSD's output harmonics at the surface is not the best location for understanding the effect of power quality on the ESP motor. The harmonics in a line are dependent on the quality of the power waveform, the operational frequency, and the length (and/or capacitance) of the line. In some embodiments, the THD (for example, the THDv or the THDi) are measured at the ESP motor, it can be determined if (or when) the motor is in danger due to poor power quality. For example, in some embodiments, the THD can be monitored at the ESP motor terminals. The downhole system can then be isolated and the issue can be solved before an electrical-related failure occurs. Such a measurement of the THD can also be provided as a THD baseline, and THD values can be monitored over time to determine if characteristics of the electrical system have changed.

Figure 2:
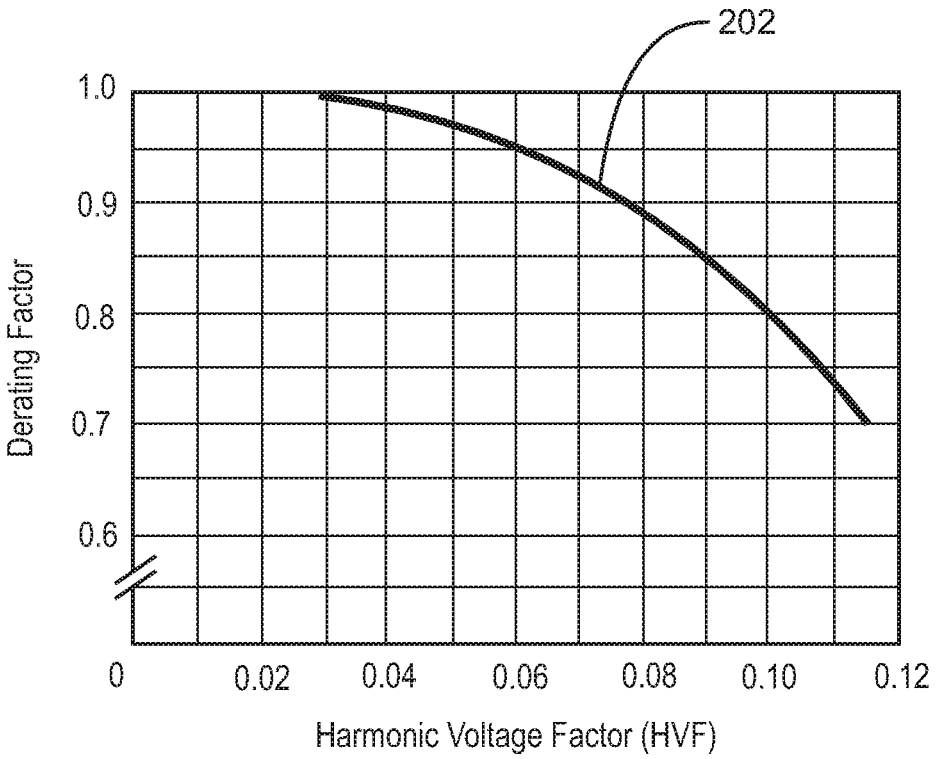
FIG. 2 is an example chart 200 depicting a de-rating curve 202 in accordance with to some embodiments.

FIG. 2 is an example chart 200 depicting a de-rating curve 202 (or downrating curve 202 or de-rated curve 202, etc.) for harmonic voltages. Curve 202 can correspond to a motor de-rating curve for harmonic voltages in accordance with the National Electrical Manufacturers Association (NEMA) MG-1 THDv motor de-rating curve, for example. Based on example harmonic voltage factors (HVFs), exemplary de-rating factors or values (or de-rated values or factors) are provided along the de-rating curve 202. In some embodiments, total harmonic distortion voltage (THDv) can be monitored at terminals of an ESP motor, and the ESP motor can be de-rated (downrated) in response to the THDv monitored at the terminals of the ESP motor. This de-rating (or downrating) of the ESP motor can be implemented in accordance with some embodiments.

Figure 3:
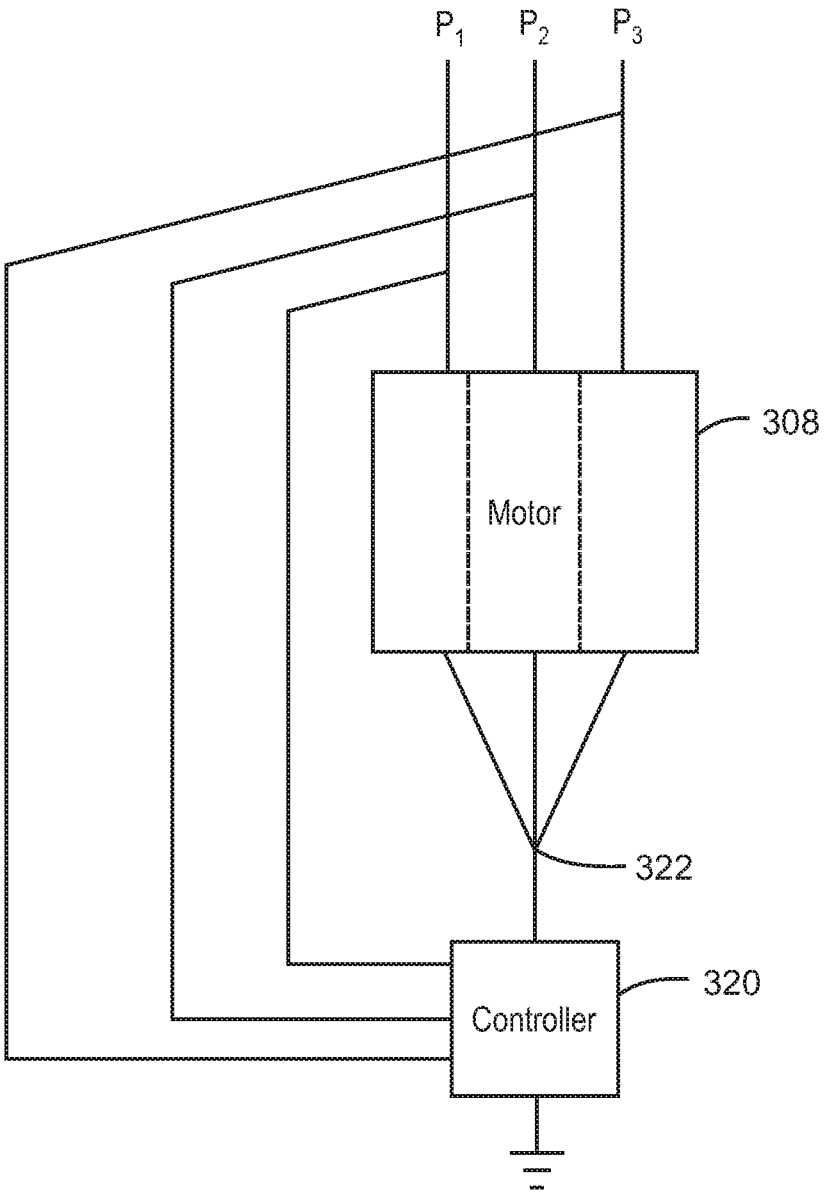
FIG. 3 is an illustration of an example system 300 in accordance with some embodiments.

FIG. 3 is an illustration of an example system 300 in accordance with some embodiments. In some embodiments, system 300 is included in an electrical submersible pump (ESP). In some embodiments, system 300 is included in the electrical submersible pump (ESP) of system 100 illustrated in FIG. 1.

System 300 includes a motor 308 and a controller 320. A power cable includes lines $P_1$, $P_2$, and $P_3$, which may be three phase wire lines (for example, three phase copper wire lines), and/or may be the same as (or similar to) lines included in power cable 114 of FIG. 1. Each of the three phases on lines $P_1$, $P_2$, and $P_3$ can carry current up and down a power cable of an ESP. In some embodiments, AC current is carried on lines $P_1$, $P_2$, and $P_3$. In some embodiments, lines $P_1$, $P_2$, and $P_3$ provide DC voltage (for example, 110 volt DC voltage) that can be used to power the downhole equipment (for example, an ESP pump, an ESP motor, a sensor, a controller such as controller 320, etc.) In some embodiments, lines $P_1$, $P_2$, and $P_3$ may be used to power motor 308. Neutral point 322 may be a neutral point (or a Y point, or a triple point, or a zero voltage point) of motor 308 that may also be coupled to a sensor (for example, such as sensor 110 of FIG. 1). In some embodiments, the sensor (and/or controller 320) may be powered through the triple point 322. Controller 320 can send high frequency signals (for example, in some embodiments, can send data signals with a 10 kHz or higher sampling frequency) back to the surface for communications via lines $P_1$, $P_2$, and $P_3$. That is, lines $P_1$, $P_2$, and $P_3$ can provide three phase power to the ESP motor (as shown by dashed lines through motor 308), can provide DC power to the triple point 322, and can provide high frequency communications (for example, in some embodiments, can provide communications with a 10 kHz or higher sampling frequency) between a controller at the surface and downhole equipment included in the ESP.

In some embodiments, controller 320 is included in a sensor (for example, is included in a sensor such as sensor 110 of the ESP of FIG. 1). In some embodiments, controller 320 is coupled to a sensor (for example, coupled to a sensor such as sensor 110 of the ESP of FIG. 1), but is an independent component. In some embodiments, controller 320 is not coupled to a sensor (for example, is not coupled to a sensor such as sensor 110 of the ESP of FIG. 1) and is an independent component (for example, is an independent component included in an ESP such as the ESP illustrated in FIG. 1). In some embodiments, controller 320 is a downhole power quality analyzer and/or a downhole power quality controller used for ESP applications. The three lines coupling controller 320 to wires $P_1$, $P_2$, and $P_3$ can be used to measure one or more characteristic of the wire such as one or more of voltage, current, frequency, induction, and/or harmonics, etc. (for example, using a separate induction coil (or inductors) around each of the wires $P_1$, $P_2$, and $P_3$).

In some embodiments, controller 320 is a total harmonic distortion (THD) controller that can control the ESP motor (for example, can control the motor 108 or the motor 308) in response to THD (for example, based on measurements received from wires $P_1$, $P_2$, and/or $P_3$). In some embodiments, controller 320 can control the ESP motor directly. In some embodiments, controller 320 can send a signal to a surface controller (for example, controller 112) so that the surface controller can control the ESP motor based on the signal sent from downhole controller 320.

In some embodiments, a power connection to provide power to controller 320 is a same power connection as a power connection to an ESP sensor (for example, at the bottom of an ESP motor such as motor 308). In some embodiments, a power connection to provide power to controller 320 is at an ESP pothead (for example, at a pothead connector connecting the motor 308 to a power cable). In some embodiments, a power connection to provide power to controller 320 is above an ESP pothead (for example, above a pothead connector connecting the motor 308 to a power cable). In some embodiments, a dedicated power source may be provided from the surface to controller 320 (for example, via one or more power cables).

In some embodiments, communications between controller 320 and devices at the surface are implemented using a same path as the ESP sensor uses for communications with devices at the surface (for example, using DC communication techniques impressed on an AC power cable). In some embodiments, communications between controller 320 and devices at the surface are implemented using a different path from the one that the ESP sensor uses for communications with devices at the surface (for example, using an independent communications path such as a high data-rate fiber optic line or some other communications line separate from the ESP power cable.

In some embodiments, data is transmitted by controller 320 to the surface (for example, to a surface controller) using all high-frequency data transmission (for example, in some embodiments, can transmit data with a 10 kHz or higher sampling frequency). In some embodiments, data is computed locally by controller 320, and all data or some data (for example, some data such as a subset of the locally computed data) is transmitted to the surface. In some embodiments, high frequency data (for example, in some embodiments, data with a 10 kHz or higher sampling frequency) is stored locally at or near the controller 320, which can be pulled for analysis and transmission to the surface. In some embodiments, the high frequency data may be compressed (for example, data with a 10 kHz or higher sampling frequency is compressed, and/or is compressed locally and/or at or near controller 320) before it is stored locally. In some embodiments, the high frequency data may be compressed and then transmitted at a lower frequency (for example, within communication bandwidth constraints).

In some embodiments, the controller 320 is a downhole power quality controller included in a sensor of an ESP (for example, included in sensor 110 of the ESP of FIG. 1). In some embodiments, controller 320 can measure (for example, at the terminals of motor 308) the total harmonic distortion (THD) of the voltage (THDv) and/or can measure the total harmonic distortion (THD) of the current (THDi). In some embodiments, controller 320 can provide an early warning for changes in the electrical system (for example, provide an early warning for deleterious changes in the electrical system). Controller 320 can be used in a manner such that live measurements are not necessary, which is advantageous compared to systems relying on the relatively slow data rates of the ESP power cable. Controller 320 can calculate THD (for example, including THDv and/or THDi) and rise times locally, for example, using edge computing. In some embodiments, a sensor (for example, sensor 110) and/or a controller (for example, controller 320) can detect maximum rise of voltage spikes and/or change of voltage over time (dV/dt). Controller 320 can send key data such as, for example, average power and/or peak power data to the surface (for example, the key data can be sent to the surface along with other sensor measurements). In some embodiments, controller 320 can transmit relative contributions of the harmonic components either continuously or on-demand, which can be used for troubleshooting. In some embodiments, operators at the surface can alter system operation in response to data sent from controller 320 to prevent failures (for example, to prevent ESP system failures).

In some embodiments, controller 320 can provide power conditioning. In some embodiments, controller 320 can implement power conditioning features including, for example, one or more of maximum voltage regulation, minimum voltage regulation, minimum voltage rise time regulation, active harmonics filter, and/or passive harmonics filter. In some embodiments, power conditioning can be implemented using a sensor (for example, sensor 110) and/or a controller (for example, controller 320). This may be implemented, for example, by detecting maximum rise of voltage spikes and/or change of voltage over time (dV/dt).

Controller 320 can be used to regulate to a maximum and/or minimum rise time. This can be implemented, for example, using passive components to avoid insulation-damaging events. In some embodiments, an active harmonic filter can be used to inject equal amounts of harmonic currents at opposite phases, for example.

In some embodiments, controller 320 can calculate one or more THD values at terminals of motor 308 (for example, including one or more THDv and/or one or more THDi values) and can adjust a speed of motor 308 if the calculated THD value(s) are not within a particular tolerance. In some embodiments, controller 320 can measure each phase of the motor 308, calculate a Fourier Transform for each phase, calculate THD for each phase, calculate a total THD, compare THD values to de-rated values (or de-rating values, downrated values, or downrating values) for the motor 308, determine whether the motor is to be de-rated (downrated) based on the compared values (for example, by determining whether the THD values are within a tolerance value), calculate a de-rated value (downrated value), and/or adjust a speed of the motor 308 based on a de-rated value (downrated value). In some embodiments, adjusting a speed of the motor 308 in this manner can be referred to as de-rating the motor, downrating the motor, etc. In some embodiments, de-rating or downrating of the motor 308 can include, for example, adjustment of the motor in order to provide for longer device life, adjustment of a speed of the motor, operating the motor at less than its rated maximum capability, operating the motor below a maximum or typical power rating, current rating, or voltage rating, lowering an operation parameter of the motor (such as, for example, lowering power, current, and/or voltage supplied to the motor), changing an operating speed of the motor, and/or stopping operation of the motor.

In some embodiments, controller 320 can calculate THD values at the terminals of motor 308 and can adjust the motor directly. In some embodiments, by using controller 320, which is located downhole at the ESP rather than at the surface, problems associated with performing similar functions at the surface (such as induction issues relating to the long length of any communication lines) do not occur.

Figure 4:
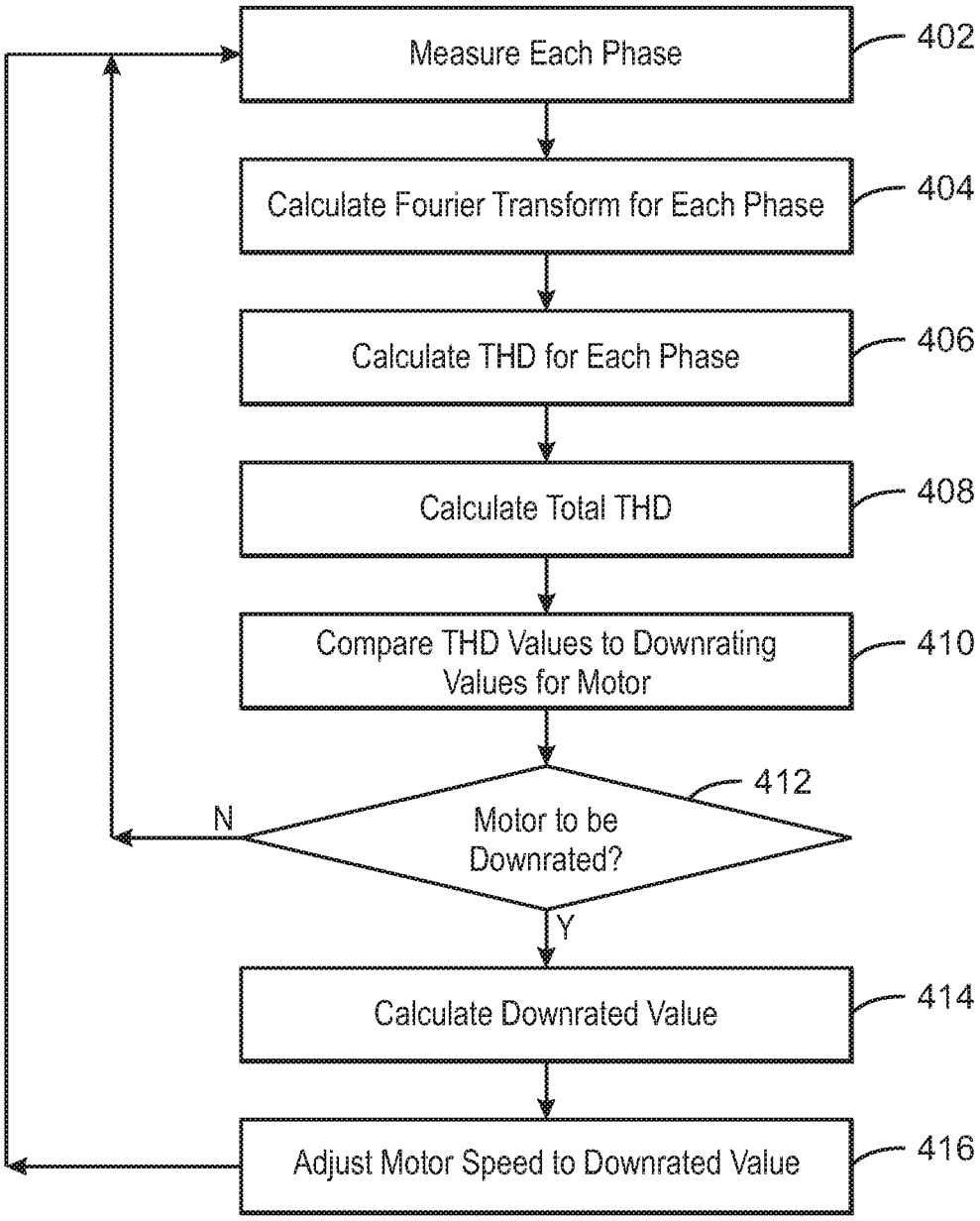
FIG. 4 is an example process flow diagram for power quality determination of a motor of an electrical submersible pump (ESP) motor in accordance with some embodiments.

FIG. 4 is an example process flow diagram 400 for power quality determination of a motor of an electrical submersible pump (ESP) motor in accordance with some embodiments. In some embodiments, FIG. 4 is an example process flow diagram 400 for adjusting motor speed of an electrical submersible pump (ESP) motor. In some embodiments, all or some of flow 400 of FIG. 4 can be implemented by a controller in an ESP (for example, at a downhole controller in an ESP). In some embodiments, all or some of flow 400 of FIG. 4 can be implemented by controller 320 of FIG. 3.

At 402, flow 400 measures each phase of a motor of an ESP. At 404, a Fourier Transform is calculated for each phase. Total harmonic distortion (THD) is calculated for each phase at 406. For example, in some embodiments, THDv and/or THDi is calculated for each phase at 406. A total THD is calculated at 408. For example, a total THD is calculated at 408 based on the THD calculated for each phase at 404. One or more calculated THD values are compared with de-rating values (or de-rated values, downrated values, downrating values, etc.) for an ESP motor at 410. For example, one or more THD calculated values are compared with one or more tolerance values at 410 (for example, in some embodiments, compared with a 3% tolerance value). A determination is made at 412 as to whether an ESP motor is to be downrated (de-rated). The determination at 412 can be made, for example, based on the comparison implemented at 410. If the ESP motor is not to be downrated (de-rated) at 412, flow 400 returns to 402. If the ESP motor is to be downrated (de-rated) at 412, a downrated (de-rated) value is calculated at 414. For example, the downrated (de-rated) value may be calculated at 414 based on the values compared at 410. At 416, a speed of an ESP motor is adjusted to the downrated value (de-rated value) calculated at 414. Flow then returns to 402. In some embodiments, adjusting a speed of an ESP motor in this manner can be referred to as de-rating the motor, or downrating the motor, etc. In some embodiments, de-rating or downrating of the motor used in reference to 410, 412, 414, and/or at 416 can include, for example, adjustment of the motor in order to provide for longer device life, adjustment of a speed of the motor, operating the motor at less than its rated maximum capability, operating the motor below a maximum or typical power rating, current rating, or voltage rating, lowering an operation parameter of the motor (such as, for example, lowering power, current, and/or voltage supplied to the motor), changing an operating speed of the motor, and/or stopping operation of the motor.

Figure 5:
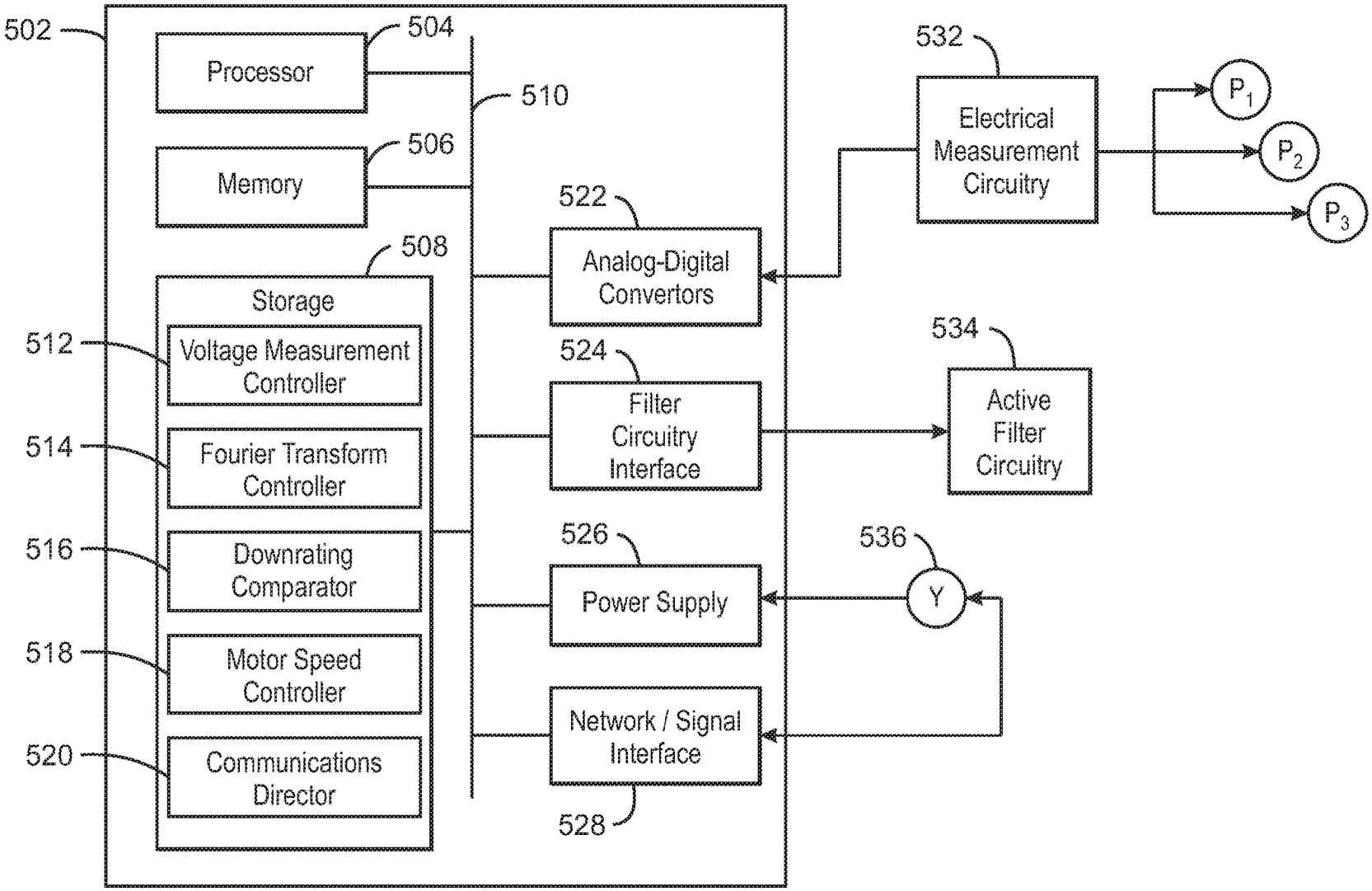
FIG. 5 is an illustration of an example system 500 in accordance with some embodiments.

FIG. 5 is an illustration of an example system 500 in accordance with some embodiments. In some embodiments, all or some of system 500 is included in a downhole system (for example, in an ESP used in a well or wellbore). In some embodiments, all or some of system 500 can be included in a downhole controller (for example, such as controller 320). In some embodiments, portions or all of system 500 can be used to implement any of the techniques illustrated and/or described herein (for example, in some embodiments, can be used to implement the process flow 400 of FIG. 4). In some embodiments, system 500 includes a computing device 502. In some embodiments, computing device 502 can be an edge computing device. In some embodiments, computing device 502 can be used as a portion or all of controller 320, for example.

Computing device 502 can include a processor 504, memory 506, and storage 508. Computing device 502 also can include a system interconnect 510 that can be used to connect various elements of the computing device 502. Storage 508 can store instructions 512 that can be executed by a processor such as processor 504 to implement voltage measurement control, instructions 514 that can be executed by a processor such as processor 504 to implement Fourier Transform control, instructions 516 that can be executed by a processor such as processor 504 to implement downrating (or de-rating) comparison, instructions 518 that can be executed by a processor such as processor 504 to implement motor speed control, and instructions 520 that can be executed by a processor such as processor 504 to direct communications. In some embodiments, processor 504 can be used to de-rate or downrate a motor, which can include, for example, adjustment of the motor in order to provide for longer device life, adjusting a speed of the motor, operating the motor at less than its rated maximum capability, operating the motor below a maximum or typical power rating, current rating, or voltage rating, lowering an operation parameter of the motor (such as, for example, lowering power, current, and/or voltage supplied to the motor), changing an operating speed of the motor, and/or stopping operation of the motor.

Computing device 502 may also include one or more analog to digital converters (AD converters) 522, filter circuitry interface 524, power supply 526, and network/signal interface 528 (for example, a network interface, NIC, or signal interface). System 500 can also include electrical measurement circuitry 532 (for example, voltage measurement circuitry and/or other electrical measurement circuitry) that may be coupled to power cable lines $P_1$, $P_2$, and $P_3$ (for example, to power cable lines $P_1$, $P_2$, and $P_3$ illustrated in FIG. 3). System 500 can also include active filter circuitry 534 coupled to the filter circuitry interface 524. Power supply 526 and network/signal interface 528 can be coupled to a neutral point 536 (or Y point, or triple point, or zero voltage point). In some embodiments, neutral point 536 can be the same as neutral point 322. Power can come into the power supply 526 via the neutral point 536. Network/signal interface 528 can communicate with the surface using high frequency signaling (for example, in some embodiments, using signaling with a 10 kHz or higher sampling frequency) via the neutral point 536.

The computing device 502 may include a processor 504 that is adapted to execute stored instructions (for example, instructions stored in processor 504, instructions stored in memory 506, and/or instructions stored in storage 508). Memory device 506 (or storage 506) can store instructions that are executable by the processor 504. The processor 504 can be a single core processor, a multi-core processor, a computing cluster, or any number of other configurations. The memory device 506 can be a memory device or a storage device, and can include volatile storage, non-volatile storage, random access memory, read only memory, flash memory, or any other suitable memory or storage system. The instructions that are executed by the processor 504 may also be used to implement any of the techniques illustrated and/or described herein. In some embodiments, processor 504 may include the same or similar features or functionality as, for example, various controllers or agents in this disclosure.

The processor 504 may be linked through the system interconnect 510 (e.g., PCI®, PCI-Express®, NuBus, etc.) to memory 506, storage 508, AD converters 522, filter circuitry interface 524, power supply 526, and network/signal interface 528, for example. Analog-Digital converters 522 may be adapted to connect the computing device 502 to electrical measurement circuitry 532. Filter circuitry interface 524 may be adapted to connect computing device 502 to active filter circuitry 534. Power supply 526 can receive power from the neutral point 536 to power the computing device 502. Network/signal interface 528 may be adapted to connect the computing device 502 to the neutral point. In some embodiments, network/signal interface 528 may be a network interface controller (also referred to herein as a NIC) that may be adapted to connect the computing device 502 through a system interconnect to a network (not depicted), or to a surface controller via a power cable, for example. In some embodiments, the network (not depicted) may be a cellular network, a radio network, a wide area network (WAN), a local area network (LAN), or the Internet, among others.

In some embodiments, the processor 504 may also be linked through the system interconnect 510 to storage device 508, and storage device 508 can include a hard drive, a solid-state drive (SSD), a magnetic drive, an optical drive, a USB flash drive, an array of drives, or any other type of storage, including combinations thereof. In some embodiments, the storage device 508 can include any suitable applications that can be used by processor 504 to implement any of the techniques described herein. In some embodiments, storage 508 stores instructions 512, 514, 516, 518, and/or 520 that are executable by the processor 504. In some embodiments, the storage device 508 can include a basic input/output system (BIOS).

In some embodiments, electrical measurement circuitry 532 can include induction coils (or inductors) on each of the power lines $P_1$, $P_2$, and $P_3$. Electrical measurement circuitry 532 is coupled to wires $P_1$, $P_2$, and $P_3$ and can be used to measure one or more characteristic of the wire such as one or more of voltage, current, frequency, induction, and/or harmonics, etc. (for example, using a separate induction coil, or a separate inductor, around each of the power line wires $P_1$, $P_2$, and $P_3$). In some embodiments, active filter interface 524 and active filter circuitry 534 can be used in a situation where active intervention occurs on the phases.

It is to be understood that the block diagram of FIG. 5 is not intended to indicate that the system 500 and/or the computing device 502 are to include all of the components shown in FIG. 5 in all embodiments. Rather, the system 500 and the computing device 502 can include fewer or additional components not illustrated in FIG. 5 (e.g., additional memory components, embedded controllers, additional modules, additional network interfaces, etc.). Furthermore, any of the functionalities may be partially, or entirely, implemented in hardware or in a processor such as processor 504. For example, the functionality may be implemented with an application specific integrated circuit, logic implemented in an embedded controller, or in logic implemented in the processor 504, among others. In some embodiments, the functionalities can be implemented with logic, wherein the logic, as referred to herein, can include any suitable hardware (e.g., a processor, among others), software (e.g., an application, among others), firmware, or any suitable combination of hardware, software, or firmware. In some embodiments, any of the functionalities can be implemented with an integrated circuit.

In some embodiments, computing device 502 may include one or more processors. In some embodiments, storage device 508 can be one or more tangible, non-transitory computer readable media that can be included in computing device 502, or can be separate media from computing device 502. The one or more tangible, non-transitory, computer-readable media may be accessed by the processor(s) over a computer interconnect. Furthermore, the one or more tangible, non-transitory, computer-readable media may include instructions (or code) to direct the processor(s) to perform operations to implement any of the techniques as illustrated and/or described herein. In some embodiments, the processor(s) can perform some or all of the same or similar functions that can be performed by other elements described herein using instructions (code) included on the media. In some embodiments, the one or more of processor(s) may include the same or similar features or functionality as, for example, various controllers, units, or agents, etc. described in this disclosure. In some embodiments, the one or more processor(s), interconnect, and/or media may be included in computing device 502. It is to be understood that any suitable number of software components may be included within the one or more tangible, non-transitory computer-readable media, depending on the specific application.

Figure 6:
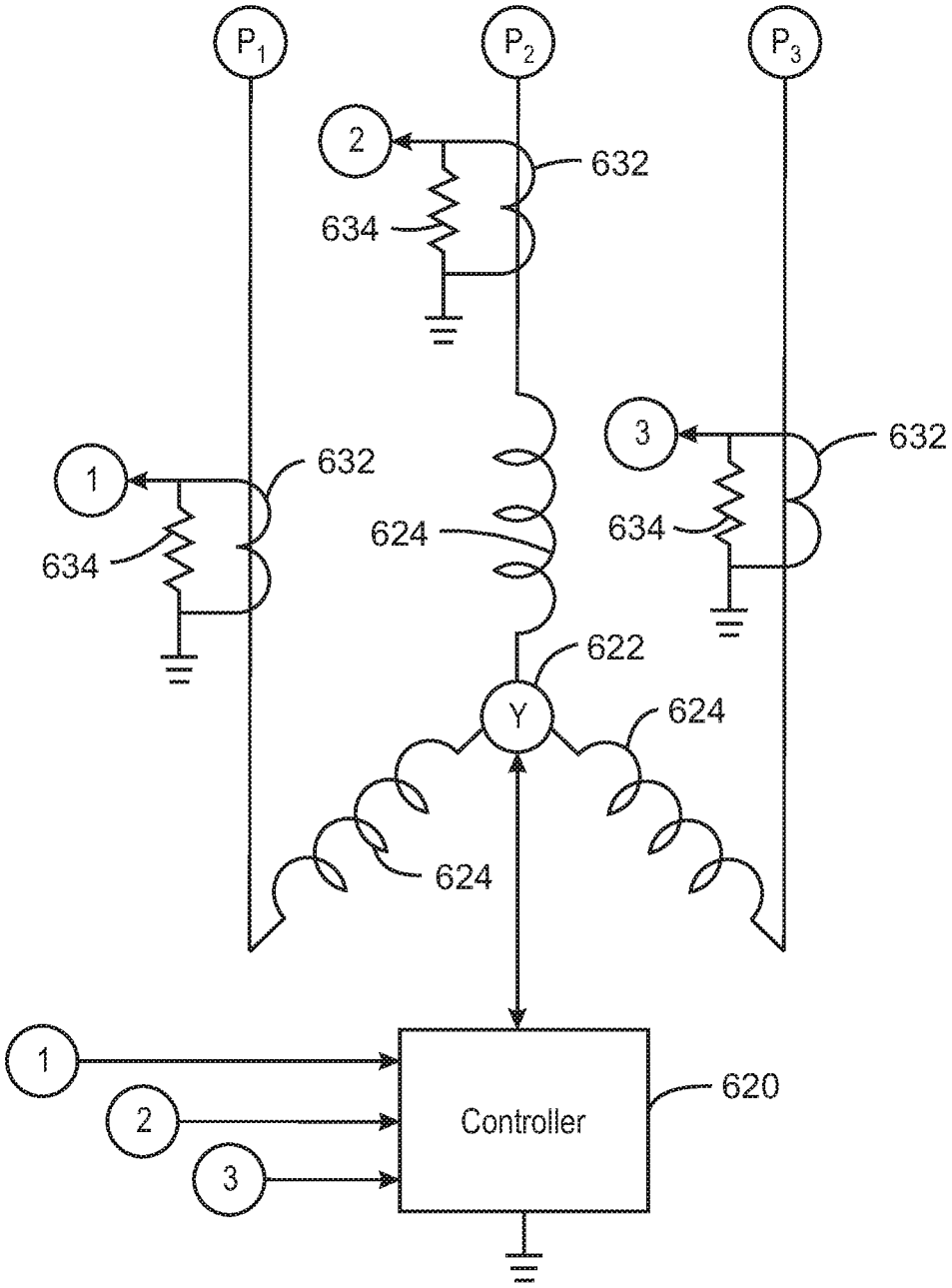
FIG. 6 is an illustration of an example system 600 in accordance with some embodiments.

FIG. 6 is an illustration of an example system 600 in accordance with some embodiments. In some embodiments, all or some of system 600 is included in a downhole system (for example, in an ESP used in a well or wellbore). In some embodiments, all or some of system 600 can be included in a downhole controller (for example, such as controller 320). In some embodiments, portions or all of system 600 can be used to implement any of the techniques illustrated and/or described herein (for example, in some embodiments, can be used to implement the process flow 400 of FIG. 4). In some embodiments, system 600 can be included in all or some of system 100, system 300, and/or system 500, for example.

System 600 includes a controller 620. In some embodiments, controller 620 can be the same as or similar to controller 320. System 600 also includes a neutral point 622 and coils 624 of a motor (for example, of an ESP motor). System 600 illustrates sensor measurement of current, voltage, and/or total harmonic distortion (THD) in accordance with some embodiments. Inductors 632 each measure the current coming out of each phase of the motor. Resistors 634 can be used across each of the inductors 632 to provide a respective voltage to controller 620. In this manner, electrical signals can be provided to controller 620 so that controller 620 can perform phase calculations for each of the phases in accordance with some embodiments. It is noted that the 1, 2 and 3 numbers in FIG. 6 illustrate lines that are connected to each other. That is, the is are coupled to each other, the 2s are coupled to each other, and the 3s are coupled to each other.

Figure 7:
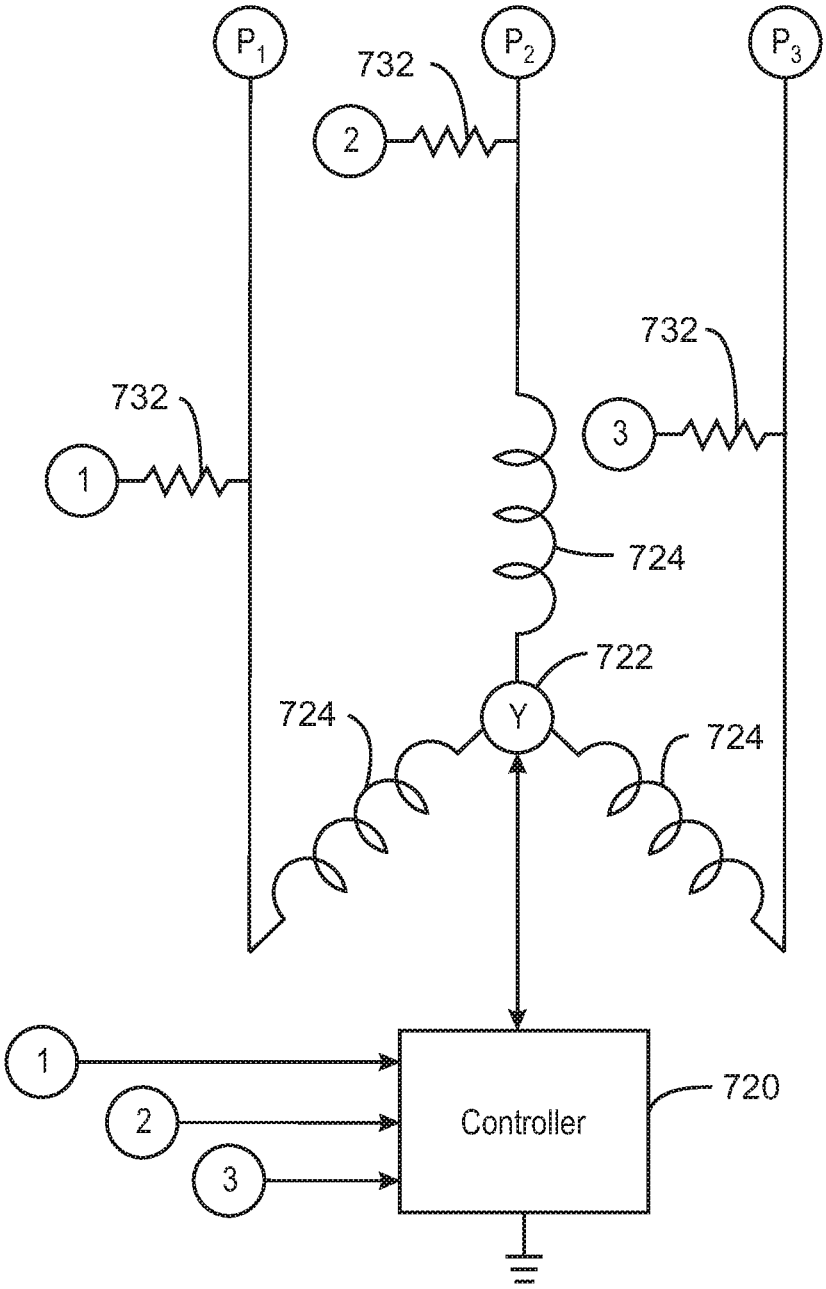
FIG. 7 is an illustration of an example system 700 in accordance with some embodiments.

FIG. 7 is an illustration of an example system 700 in accordance with some embodiments. In some embodiments, all or some of system 700 is included in a downhole system (for example, in an ESP used in a well or wellbore). In some embodiments, all or some of controller 700 can be included in a downhole controller (for example, such as controller 320). In some embodiments, portions or all of system 700 can be used to implement any of the techniques illustrated and/or described herein (for example, in some embodiments, can be used to implement the process flow 400 of FIG. 4). In some embodiments, system 700 can be included in all or some of system 100, system 300, and/or system 500, for example.

System 700 includes a controller 720. In some embodiments, controller 720 can be the same as or similar to controller 320. System 700 also includes a neutral point 722 and coils 724 of a motor (for example, of an ESP motor). System 700 illustrates sensor measurement of current, voltage, and/or total harmonic distortion (THD) in accordance with some embodiments. Resistors 732 can each be coupled between one of the power lines and controller 720. In this manner, electrical signals can be provided to controller 720 so that controller 720 can perform phase calculations for each of the phases in accordance with some embodiments. It is noted that the 1, 2 and 3 numbers in FIG. 7 illustrate lines that are connected to each other. That is, the 1s are coupled to each other, the 2s are coupled to each other, and the 3s are coupled to each other.

Figure 8:
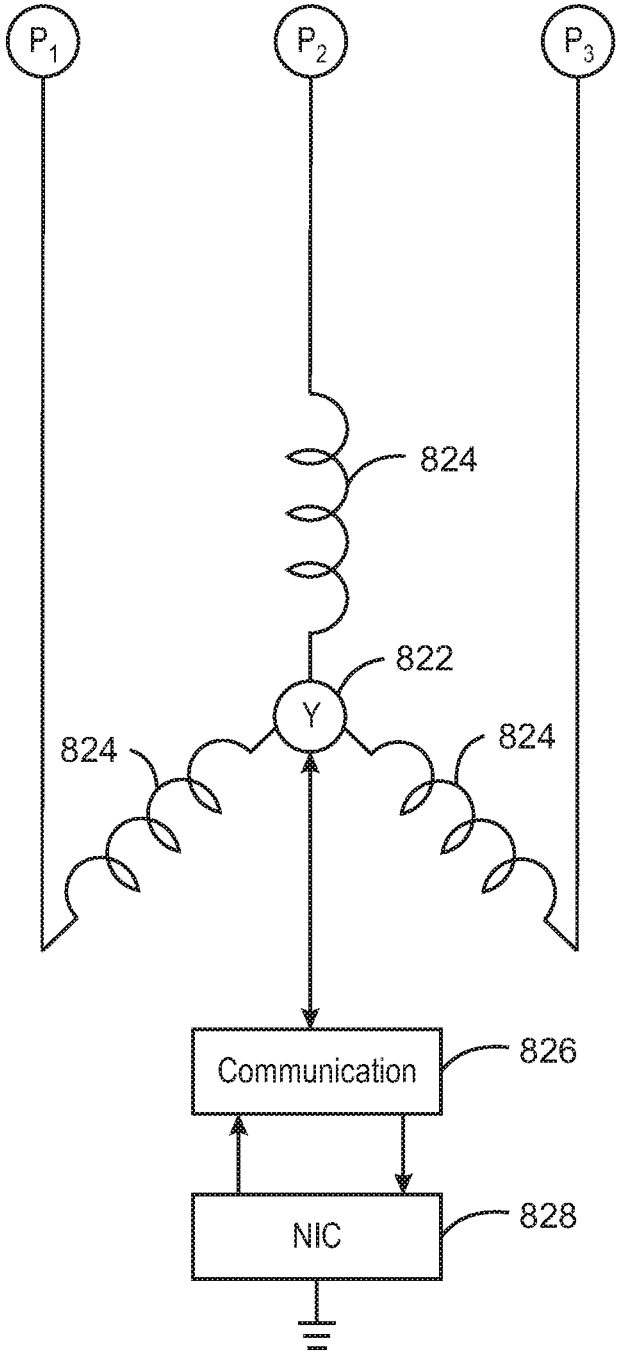
FIG. 8 is an illustration of an example system 800 in accordance with some embodiments.

FIG. 8 is an illustration of an example system 800 in accordance with some embodiments. In some embodiments, all or some of system 800 is included in a downhole system (for example, in an ESP used in a well or wellbore). In some embodiments, all or some of system 800 can be included in a downhole controller (for example, such as controller 320). In some embodiments, portions or all of system 800 can be used to implement communications relating to any of the techniques illustrated and/or described herein (for example, in some embodiments, can be used to implement the process flow 400 of FIG. 4). In some embodiments, system 800 can be included in all or some of system 100, system 300, system 500, system 600, system 700 and/or system 900, for example.

System 800 includes a neutral point 822 and coils 824 of a motor (for example, of an ESP motor). System 800 illustrates communications 826 (for example, a high frequency communications unit such as, for example, a unit that can provide communications with a 10 kHz or higher sampling frequency) and network/signal interface 828 (for example, a network interface controller or NIC). In some embodiments, communications 826 can be a filter that connects to the neutral point 822 (or Y point, triple point, etc.) and can impose high frequency signaling (for example, in some embodiments, can impose signaling with a 10 kHz or higher sampling frequency) on the neutral point 822 to communicate (for example, to the surface) via the power cable signal lines $P_1$, $P_2$, and $P_3$ (for example, using Ethernet over Power communications).

Figure 9:
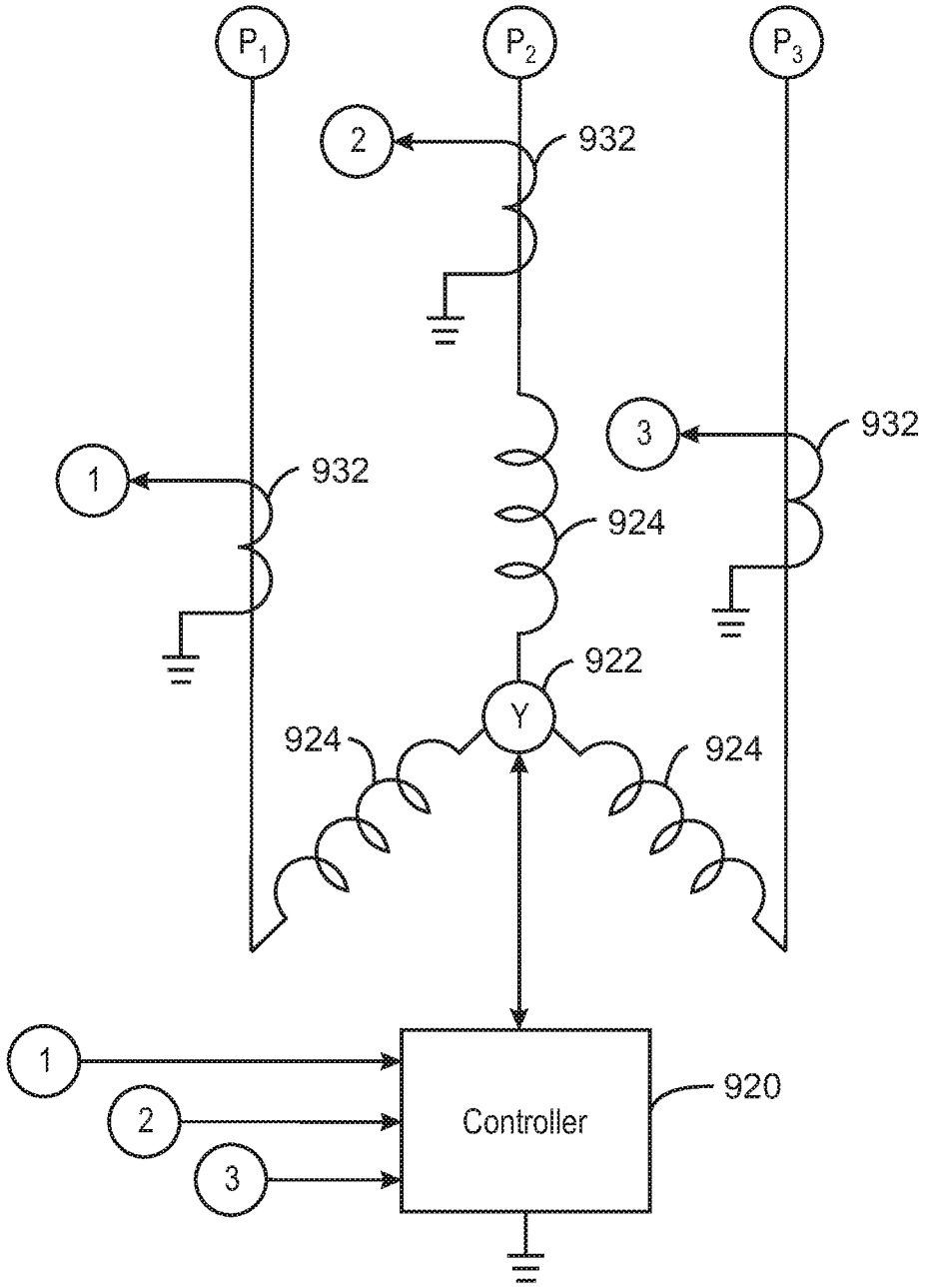
FIG. 9 is an illustration of an example system 900 in accordance with some embodiments.

FIG. 9 is an illustration of an example system 900 in accordance with some embodiments. In some embodiments, all or some of system 900 is included in a downhole system (for example, in an ESP used in a well or wellbore). In some embodiments, all or some of system 900 can be included in a downhole controller (for example, such as controller 320). In some embodiments, portions or all of system 600 can be used to implement any of the techniques illustrated and/or described herein (for example, in some embodiments, can be used to implement the process flow 400 of FIG. 4). In some embodiments, system 900 can be included in all or some of system 100, system 300, and/or system 500, for example.

System 900 includes a controller 920. In some embodiments, controller 920 can be the same as or similar to controller 920. System 900 also includes a neutral point 922 and coils 924 of a motor (for example, of an ESP motor). System 900 illustrates sensor measurement of current, voltage, and/or total harmonic distortion (THD) in accordance with some embodiments. Inductors 932 each measure the current coming out of each phase of the motor. In some embodiments, a current detection system may be included in controller 920 to detect current at each of the phases. In some embodiments, resistors (not illustrated in FIG. 9) are included in controller 920 in a manner similar to resistors 634 in FIG. 6, and can be used across each of the inductors 932 to provide a respective voltage to be used by controller 920. In this manner, electrical signals can be provided to controller 920 so that controller 920 can perform phase calculations for each of the phases in accordance with some embodiments. It is noted that the 1, 2 and 3 numbers in FIG.

9 illustrate lines that are connected to each other. That is, the is are coupled to each other, the 2s are coupled to each other, and the 3s are coupled to each other.

Figure 10:
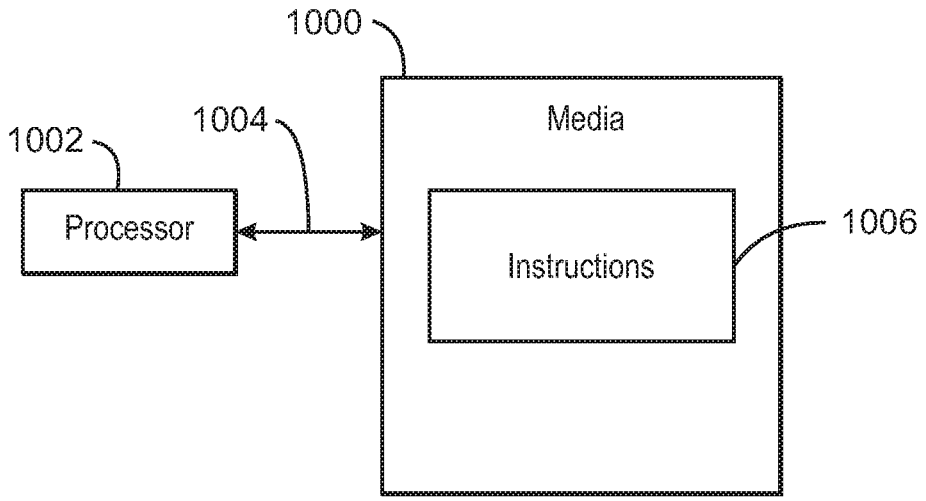
FIG. 10 is an illustration of an example block diagram of one or more processors and one or more tangible, non-transitory computer readable media in accordance with some embodiments.

FIG. 10 is a block diagram of an example of one or more processors 1002 and one or more tangible, non-transitory computer readable media 1000 for electric submersible pump (ESP) power adjustment, etc. The one or more tangible, non-transitory, computer-readable media 1000 may be accessed by the processor(s) 1002 over a computer interconnect 1004. Furthermore, the one or more tangible, non-transitory, computer-readable media 1000 may include instructions (or code) 1006 to direct the processor(s) 1002 to perform operations as described herein. In some embodiments, processor 1002 is one or more processors. In some embodiments, processor(s) 1002 can perform some or all of the same or similar functions that can be performed by other elements described herein using instructions (code) 1006 included on media 1000 (for example, some or all of the functions or techniques illustrated in or described in reference to any of FIGS. 1-9). In some embodiments, one or more of processor(s) 1002 may include the same or similar features or functionality as, for example, various controllers, units, or agents, etc. described in this disclosure. In some embodiments, one or more processor(s) 1002, interconnect 1004, and/or media 1000 may be included, for example, in system 100, controller 320, system 500 (for example, in computing device 502), controller 620, controller 720, controller 920, etc.) In some embodiments, any of the techniques described and/or illustrated herein may be implemented by one or more processors 1002 executing instructions 1006.

Various components discussed in this specification may be implemented using software components. These software components may be stored on the one or more tangible, non-transitory, computer-readable media 1000, as indicated in FIG. 10. For example, ESP motor power adjustment and/or some or all of flow 400, etc. may be adapted to direct the processor(s) 1002 to perform one or more of any of the operations described in this specification and/or in reference to the drawings.

It is to be understood that any suitable number of software components may be included within the one or more tangible, non-transitory computer-readable media 1000. Furthermore, any number of additional software components shown or not shown in FIG. 10 may be included within the one or more tangible, non-transitory, computer-readable media 1000, depending on the specific application.

The various techniques and/or operations described herein (for example, in reference to any one or more of FIGS. 1-10) may be performed by a control unit or controller including one or more processors, monitoring logic, control logic, software, firmware, agents, controllers, logical software agents, system agents, and/or other modules. For example, in some embodiments, some or all of the techniques and/or operations described herein may be implemented by a system agent. Due to the variety of modules and their configurations that may be used to perform these functions, and their distribution through the system and/or in a different system, they are not all specifically illustrated in their possible locations in the figures.

Reference in the specification to "one embodiment" or "an embodiment" or "some embodiments" of the disclosed subject matter means that a particular feature, structure, or characteristic described in connection with the embodiment is included in at least one embodiment of the disclosed subject matter. Thus, the phrase "in one embodiment" or "in some embodiments" may appear in various places throughout the specification, but the phrase may not necessarily refer to the same embodiment or embodiments.

While the present techniques may be susceptible to various modifications and alternative forms, the example examples discussed above have been shown only by way of example. However, it should again be understood that the present techniques are not intended to be limited to the particular examples disclosed herein. Indeed, the present techniques include all alternatives, modifications, and equivalents falling within the true spirit and scope of the appended claims.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. An electric submersible pump, comprising:

a pump;

an electric motor to drive the pump; and a controller to:

monitor at one or more terminals of the electric motor a value relating to total harmonic distortion at a sampling frequency of at least 10 kHz;

determine whether to de-rate the electric motor in response to the monitoring at the one or more terminals of the electric motor of the value relating to the total harmonic distortion;

determine a de-rated value in response to the determination to de-rate the electric motor; and transmit a signal to the electric motor to adjust a speed of the electric motor based on the de-rated value.

2. The electric submersible pump of claim 1, the controller to de-rate the electric motor in response to the monitoring at the one or more terminals of the electric motor of the value relating to the total harmonic distortion.

3. The electric submersible pump of claim 1, wherein the value relating to total harmonic distortion includes at least one of induction, current, frequency, or voltage at the one or more terminals of the electric motor.

4. The electric submersible pump of claim 1, the controller to:

measure phases of the electric motor;

calculate a total harmonic distortion based on the value relating to the total harmonic distortion; and determine a de-rated value in response to the determination to de-rate the electric motor.

5. The electric submersible pump of claim 1, the controller to:

adjust a speed of the electric motor based on the de-rated value.

6. The electric submersible pump of claim 1, the controller to provide an indication to de-rate the electric motor in response to the monitoring at the one or more terminals of the electric motor of the value relating to the total harmonic distortion.

7. The electric submersible pump of claim 1, the controller to perform a Fourier Transform for phases of the electric motor.

8. The electric submersible pump of claim 1, wherein the total harmonic distortion includes at least one of total harmonic distortion on the voltage or total harmonic distortion on the current.

9. The electric submersible pump of claim 1, wherein the controller is a downhole controller.

10. The electric submersible pump of claim 1, wherein the controller is included in a sensor of the electric submersible pump, or the controller is coupled to a sensor of the electrical submersible pump.

11. The electric submersible pump of claim 1, comprising a power connection to provide power to the controller at a bottom of the electric motor, to provide power to the controller at a pothead of the electric submersible pump, or to provide power to the controller above a pothead of the electric submersible pump.

12. The electric submersible pump of claim 1, comprising a communications path between the controller and a surface controller, wherein the communications path is a same path as a communications path between a sensor of the electric submersible pump and the surface controller, or the communications path is a path that is independent from a communications path between a sensor of the electric submersible pump and the surface controller.

13. The electric submersible pump of claim 1, the controller to transmit data related to the data collected in the monitoring to a surface controller.

14. The electric submersible pump of claim 1, the controller to compress data collected with the sampling frequency of at least 10 kHz and to store the compressed data.

15. The electric submersible pump of claim 1, the controller to implement one or more of maximum voltage regulation, minimum voltage rise time regulation, active harmonics filtering, or passive harmonics filtering.

16. The electric submersible pump of claim 1, wherein de-rate the electric motor includes one or more of adjust the motor in order to provide for longer device life, operate the motor at less than its rated maximum capability, operate the motor below a maximum or typical power rating, current rating, or voltage rating, lower an operation parameter of the motor, lower a power of the motor, lower a current supplied to the motor, lower a voltage supplied to the motor, change an operating speed of the motor, or stopping operation of the motor.

17. A method to be implemented in an electric submersible pump, comprising:

monitoring, at one or more terminals of an electric motor of the electric submersible pump, a value relating to total harmonic distortion at a sampling frequency of at least 10 kHz;

determining whether to de-rate the electric motor in response to the monitoring at the one or more terminals of the electric motor of the value relating to the total harmonic distortion;

if it is determined to de-rate the electric motor, determining a de-rated value in response to the determination to de-rate the electric motor; and adjusting a speed of the electric motor based on the de-rated value.

18. The method of claim 17, comprising de-rating the electric motor in response to the monitoring at the one or more terminals of the electric motor of the value relating to the total harmonic distortion.

19. The method of claim 17, wherein de-rate the electric motor includes one or more of adjust the motor in order to provide for longer device life, operate the motor at less than its rated maximum capability, operate the motor below a maximum or typical power rating, current rating, or voltage rating, lower an operation parameter of the motor, lower a power of the motor, lower a current supplied to the motor, lower a voltage supplied to the motor, change an operating speed of the motor, or stopping operation of the motor.

20. One or more tangible, non-transitory machine readable media comprising a plurality of instructions that, in response to being executed on at least one processor, cause the at least one processor to:

monitor, at one or more terminals of an electric motor of an electric submersible pump, a value relating to total harmonic distortion at a sampling frequency of at least 10 kHz;

determine whether to de-rate the electric motor in response to the monitoring at the one or more terminals of the electric motor of the value relating to the total harmonic distortion; and transmit a signal to the electric motor an adjustment to a speed of the electric motor based on the de-rated value.

21. The one or more tangible, non-transitory machine readable media of claim 20, comprising a plurality of instructions that, in response to being executed on at least one processor, cause the at least one processor to de-rate the electric motor in response to the monitoring at the one or more terminals of the electric motor of the value relating to the total harmonic distortion.

22. The one or more tangible, non-transitory machine readable media of claim 20, wherein de-rate the electric motor includes one or more of adjust the motor in order to provide for longer device life, operate the motor at less than its rated maximum capability, operate the motor below a maximum or typical power rating, current rating, or voltage rating, lower an operation parameter of the motor, lower a power of the motor, lower a current supplied to the motor, lower a voltage supplied to the motor, change an operating speed of the motor, or stopping operation of the motor.

23. An electric submersible pump, comprising:

means for monitoring, at one or more terminals of an electric motor of the electric submersible pump, a value relating to total harmonic distortion at a sampling frequency of at least 10 kHz;

means for determining whether to de-rate the electric motor in response to the means for monitoring at the one or more terminals of the electric motor of the value relating to the total harmonic distortion;

means for determining a de-rated value in response to the determination to de-rate the electric motor; and means for transmitting a signal to the electric motor an adjustment to a speed of the electric motor based on the de-rated value.

24. The electric submersible pump of claim 23, comprising means for de-rating the electric motor in response to the means for monitoring at the one or more terminals of the electric motor of the value relating to the total harmonic distortion.

25. The electric submersible pump of claim 23, wherein de-rate the electric motor includes one or more of adjust the motor in order to provide for longer device life, adjust a speed of the motor, operate the motor at less than its rated maximum capability, operate the motor below a maximum or typical power rating, current rating, or voltage rating, lower an operation parameter of the motor, lower a power of the motor, lower a current supplied to the motor, lower a voltage supplied to the motor, change an operating speed of the motor, or stopping operation of the motor.

26. A system comprising:

a wellhead;

an electric submersible pump, including:

a pump;

an electric motor to drive the pump; and a controller to:

monitor at one or more terminals of the electric motor a value relating to total harmonic distortion at a sampling frequency of at least 10 kHz;

determine whether to de-rate the electric motor in response to the monitoring at the one or more terminals of the electric motor of the value relating to the total harmonic distortion;

determine a de-rated value in response to the determination to de-rate the electric motor; and transmit a signal to the electric motor to adjust a speed of the electric motor based on the de-rated value; and one or more cable coupled to the electric submersible pump, the one or more cable capable of providing power or communications, or both power and communications, between the electric submersible pump and one or more surface device.

27. The system of claim 26, the controller to de-rate the electric motor in response to the monitoring at the one or more terminals of the electric motor of the value relating to the total harmonic distortion.

28. The system of claim 26, wherein de-rate the electric motor includes one or more of adjust the motor in order to provide for longer device life, adjust a speed of the motor, operate the motor at less than its rated maximum capability, operate the motor below a maximum or typical power rating, current rating, or voltage rating, lower an operation parameter of the motor, lower a power of the motor, lower a current supplied to the motor, lower a voltage supplied to the motor, change an operating speed of the motor, or stopping operation of the motor.

* * * * *